United States Patent [19]

Curry

[11] Patent Number: 4,513,888

[45] Date of Patent: Apr. 30, 1985

[54] DISPENSING CAP

[76] Inventor: John J. Curry, 2 S. 752 Theresa Ct., Oak Brook, Ill. 60521

[21] Appl. No.: 428,742

[22] Filed: Sep. 30, 1982

[51] Int. Cl.[3] ..... B65D 55/02

[52] U.S. Cl. ..... 222/153; 222/517; 222/498; 222/546; 215/213

[58] Field of Search ..... 222/153, 498, 517, 540, 222/544–546, 562, 563; 215/211, 213, 235, 237, 239, 245

[56] References Cited

U.S. PATENT DOCUMENTS

| | | | |
|---|---|---|---|
| 3,604,585 | 9/1971 | Towns | 222/153 |
| 4,010,875 | 3/1977 | Babiol | 222/517 |
| 4,209,100 | 6/1980 | Uhlig | 222/153 |
| 4,220,248 | 9/1980 | Wilson et al. | 215/235 |
| 4,235,349 | 11/1980 | Uhlig | 215/211 |
| 4,244,495 | 1/1981 | Lorscheid et al. | 222/153 |
| 4,401,225 | 8/1983 | Schwaikert | 215/211 |

*Primary Examiner*—Charles A. Marmor

*Attorney, Agent, or Firm*—Charles E. Brown; Charles A. Brown

[57] ABSTRACT

A dispensing cap having an integral spring hinge concept for a snap lid cap. The dispensing cap includes integral child resistance means which requires that a certain amount of pressure be applied to a portion of the dispensing cap in order to expose an under portion of the cap.

5 Claims, 6 Drawing Figures

DISPENSING CAP

This relates to a novel dispensing cap which may be attached to a container by means of either a snap lug arrangement or a screw threaded type arrangement. The dispensing cap provides a combination of cap safety child proof access means whereby the cap may not be opened and exposure to the internal contents of the container achieved without exerting sufficient force to a portion of the dispensing cap resulting in the exposure of a portion of the cap by which it is moved into an open position. Further, the dispensing cap has integral hinge means between the pivoting cap panel and the body of the dispensing cap whereby the cap panel in its raised position will be maintained in an out of the way position from the dispensing outlet.

It can be greatly appreciated that quite often these child safety caps are biased in such a manner that the cap itself tends to get into the way when one attempts to dispense material from within the container. It is proposed that this invention provides an alternative to the child safety dispensing caps currently within the market.

With the above, and other objects in view that will hereinafter appear, the nature of the invention will be more clearly understood by reference to the following detailed description, the appended claims and the several views illustrated in the accompanying drawings.

Figure 1:
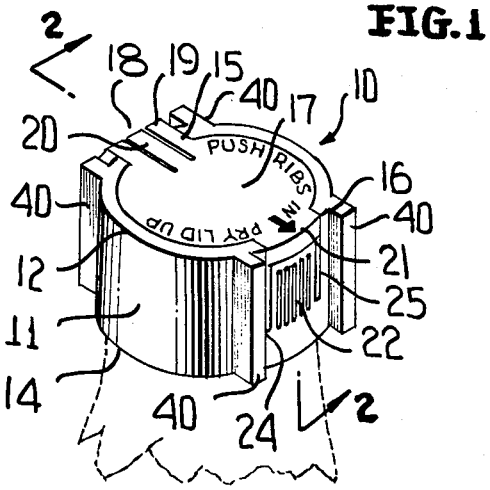
FIG. 1 is an elevational view of the dispensing cap and shows the mounting of the dispensing cap upon the neck portion of a container.
Figure 2:
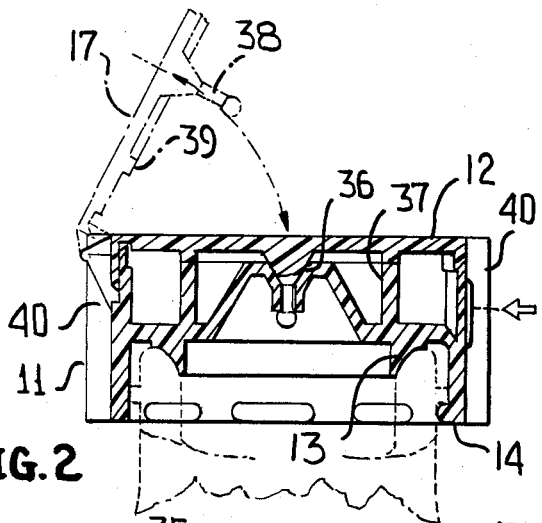
FIG. 2 is a sectional view taken along the lines 2—2 of FIG. 1 showing the operative movement of the cap panel between its open and closed position.

Referring to the drawings in detail, it will be seen that there is illustrated in FIG. 1 a dispensing cap which is formed in accordance with this invention. The dispensing cap is generally identified by the numeral 10. The dispensing cap 10 has an annular ring 11 having an upper terminal end 12 and a lower terminal end 14. The annular ring has two opposed recesses 15 and 16 formed in the upper terminal end 12.

The dispensing cap 10 further includes a cover 17 which is so configurated to conform to the innermost structure of the annular ring 11. The cover 17 includes a portion 18 which defines a hinge structure 19 and a corresponding bias structure 20. The hinge structure 19 integrally connects the cover 17 to the annular ring 11 in the area designated as the recess 15. The hinge structure 19 further provides movement of the cover 17 between an open and closed position with respect to the annular ring 11.

The cover 17 further includes a tab portion 21 which is an extension thereof and is constructed to correspond to the recess 16. The tab 21 permits a user to effectively operate the cover 17 from its closed position upwardly to an open position from the annular ring 11.

The annular ring 11 further includes a flexible panel portion 22 disposed immediately below and within the recess 16. The flexible panel 22 is defined by two score lines 24 and 25, respectively which extend from the uppermost edge 12 of the annular ring 11 directly beneath the recess 16 in a substantially perpendicular direction with respect to the uppermost edge 12 towards the lowermost edge 14. The flexible panel 22 further includes at its uppermost portion, adjacent the recess 16, a tapered edge 26. The tapering edge 26 compliments a corresponding tapered edge 27 which is located on the underside tab 21 of the cover 17.

Due to the mobility of the flexible portion 22, there is required some physical exertion by the user whereby the flexible panel 22 is moved inwardly and as a result of the relationship with respect to the tapered edges 26 and 27 the inward movement of the flexible panel 22 forces the cover 17 in an upwardly manner so as to facilitate the opening of the cover.

Referring specifically to the hinge structure 19, it will be noted that the hinge structure is a cooperating element which effectively forms a portion of the cover 17 as well as a portion of the annular ring 11 disposed closely adjacent to the recess 15. The hinging portion of the hinge structure 19 is designated by numeral 23. The flexible web 23 is constructed from the same material as the dispensing cap 11, which is normally of flexible, pliable plastic material and is a one-piece continuous article.

The biasing structure 20 is essentially an extension of the cover 17 and is defined by a pair of score lines 28, 29, respectively which lie between the hinge structure 19. The biasing structure 20 consists of two elements. The first is the extension of the cover 17 identified by numeral 30 and is in an L-shaped configuration having a lower tapered end 31. The second element of the biasing structure 20 consists of an extension 32 of the annular ring 11 extending upwardly from the recess 15 towards the uppermost terminal end 12. The second element 32 has a tapered edge 34 which corresponds to the tapered edge 31 of the first element 30, such that when the cover 17 is in its normally open position, the respective edges 31 and 34 rest upon one another in mating relationship thereby maintaining the cover 17 in an open and out of the way position with respect to the dispensing cap 10.

Further, the tapered edges 31 and 34 integrally act upon one another in such a manner, when the cover 17 is moved from an open to a closed position or from a closed to an open position, that a springing action is provided to assist in movement of the cover 17 between these operative positions. Further, it will be noted that the first element of element 30 due to the memory and elasticity of the plastic material acts as a spring by flexing where it is attached to the cover 17.

Referring now to the innermost structure of the dispensing cap 10, there is disposed within the annular ring 11 an intermediate panel 35 which is located generally between the uppermost terminal edge 12 and the lowermost terminal edge 14. The intermediate panel 35 in the area most clealy adjacent to the lower terminal edge 14 has conventional structure for attaching the dispensing cap 10 to a container. Although not specifically illustrated, it may be in the form of lugs for a snap fit attachment to a container or screw threads for readily securing the dispensing cap also to a screw type container. It will also be noted that sealing means 13 are provided whereby a tight seal may be effected between an opening of a container and the attachment of the dispensing cap 10. Furthermore, the intermediate panel 35 includes a centrally located dispensing opening 36 through which the contents of the container may be dispersed. The intermediate panel 35 also includes an annular sealing ring 37 which is positioned adjacent the dispensing opening 36.

In this respect, the cover 17 on its lowermost portion which directly faces the intermediate panel 35 includes a centrally located stopper 38 which is constructed to correspond in mating relationship to the dispensing opening 36 and provides a seal when positioned in mating relationship. Furthermore, the cover 17 includes an annular sealing ring 39 which compliments the annular sealing ring 37 of the intermediate panel 35. The arrangement of the dispensing opening 36 and the corresponding stopper 38, as well as the respective annular sealing rings 37 and 39 provide a dispensing cap which when the cover 17 is in a closed position will not leak fluids.

Furthermore, reinforcing structure which is a perpendicular extenstion of the annular ring 11 is employed in areas closely adjacent to the respective recesses 15 and 16. As seen in the illustrations, it will be noted that the reinforcing structure consists of a plurality of perpendicular bars 40. Each bar 40 is located on adjacent sides of each of the recesses 15 and 16. In addition, the reinforcing structure provides protection to the hinge structure 19, the biasing structure 20, and the flexible panel 22.

Figure 5:
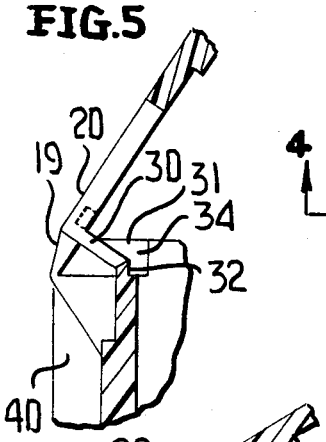
FIG. 5 is a fragmentary sectional view showing the appropriate hinge relationship when the cap panel is in its normally open position.
Figure 3:
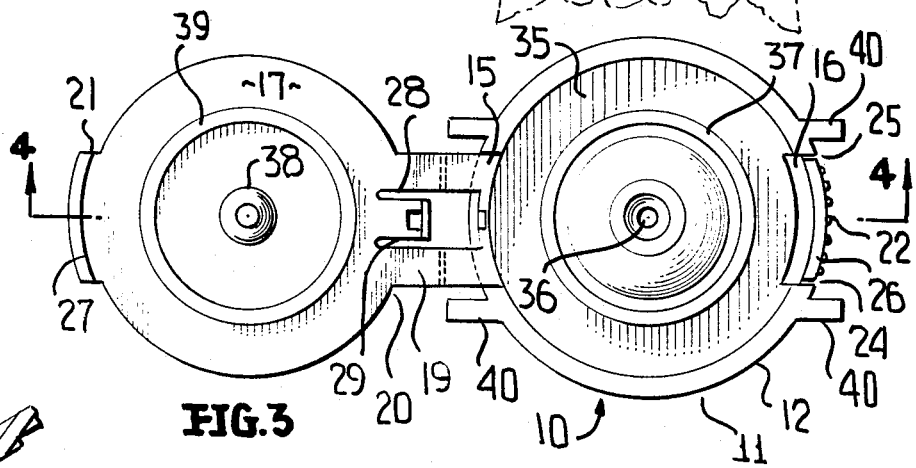
FIG. 3 is a top plan view of the dispensing cap showing the cap panel in its fully extended open position.
Figure 6:
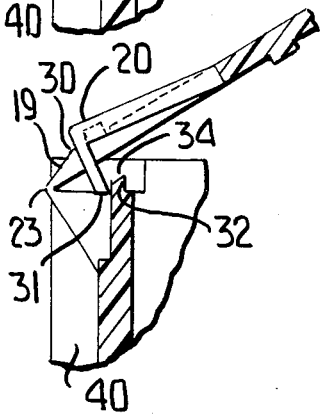
FIG. 6 is a fragmentary sectional view similar to FIG. 5, but illustrating the closing movement of the hinge means when the cap panel is between its normally open position and closed position.
Figure 4:
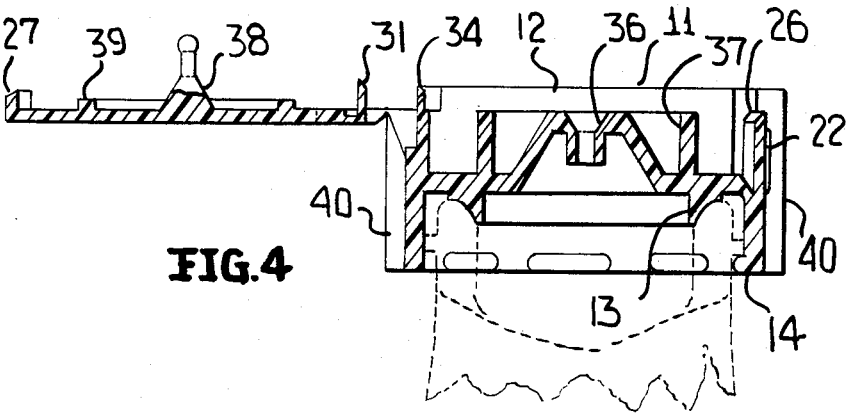
FIG. 4 is a sectional view taken along lines 4—4 of FIG. 3 showing the elements of the dispensing cap similar to that in FIG. 2.

Briefly, a description of the working arrangement of the dispensing cap 10 is that first, an individual inserts his finger or thumb between the pair of bars 40 and upon the flexible panel 22. He exerts a proper amount of force and moves the flexible panel 22 inwardly whereby the tapered edge 26 effectively cams and moves the cover 17 in an upwardly direction. Once the cover 17 has been moved upwardly to an exposed position, the user's finger or thumb may further move the cover panel 17 to an upwardly open position during which movement the biasing structure 20 effectively operates as illustrated in FIG. 6 of the drawings. It will be noted that a camming effect is provided by the respective edges 31 and 34 whereby due to the resiliency of the biasing first element 30 the cover panel 17 springs to an open position. Finally, the cover panel 17 comes to rest in a normally open and out of the way position as best seen in FIG. 5 of the drawings by the mating relationship of the edges 31 and 34.

Although only a preferred embodiment of the dispensing cap construction has been specifically illustrated and described herein, it is to be understood that minor variations may be made in the details of the dispensing cap without departing from the spirit and scope of this invention, as described by the appended claims.

I claim:

1. A dispensing cap comprising an annular ring having upper and lower terminal ends, an intermediate panel being positioned between said upper and lower terminal ends in a generally normal position to said terminal ends, said intermediate panel having a dispensing opening located therein, annular sealing means fixed to said intermediate panel and projecting generally parallel to said lower terminal end, retaining means projecting generally normal from said lower terminal end, said sealing means and said retaining means facilitating said cap to be attached to a container, said upper terminal end having two opposed recesses formed therein, a cover, a first of said recesses having hinge means for hingeably securing said cover to said annular ring, said hinge means including biasing means for maintaining said cover in an open position, said cover having a tab, a second of said recesses defining an opening to receive said tab when said cover is in a closed position, a portion of said annular ring having a flexible panel beneath said second recess, said flexible panel being capable of movement inwardly of said annular ring when radially inward pressure of sufficient force is exerted by a user to expose a portion of said cover tab thereby facilitating movement of said cover from the closed position upwardly to the open position, and said flexible panel being defined by two transverse substantially parallel slots extending from said second recess.

2. A dispensing cap according to claim 1 wherein reinforcing means is formed closely adjacent and parallel of said two transverse slots.

3. A dispensing cap according to claim 2 wherein said reinforcing means extends the transverse length of said annular ring.

4. A dispensing cap comprising an annular ring having upper and lower terminal ends, an intermediate panel being positioned between said upper and lower terminal ends in a generally normal position to said terminal ends, said intermediate panel having a dispensing opening located therein, annular sealing means fixed to said intermediate panel and projecting generally parallel to said lower terminal end, retaining means projecting generally normal from said lower terminal end, said sealing means and said retaining means facilitating said cap to be attached to a container, said upper terminal end having two opposed recesses formed therein, a cover, a first of said recesses having hinge means for hingeably securing said cover to said annular ring, said hinge means including biasing means for maintaining said cover in an open position, said cover having a tab, a second of said recesses defining an opening to receive said tab when said cover is in a closed position, a portion of said annular ring having a flexible panel beneath said second recess, said flexible panel being capable of movement inwardly of said annular ring when radially inward pressure of sufficient force is exerted by a user to expose a portion of said cover tab thereby facilitating movement of said cover from the closed position upwardly to the open position, and reinforcing means being positioned on adjacent sides of said first recess.

5. A dispensing cap according to claim 4 wherein said second reinforcing means extends the transverse length of said annular ring.

* * * * *